US008136302B2

(12) United States Patent
Trujillo et al.

(10) Patent No.: US 8,136,302 B2
(45) Date of Patent: Mar. 20, 2012

(54) SAFETY GATE

(76) Inventors: James Trujillo, Plumas Lake, CA (US); Erika Trujillo, Plumas Lake, CA (US); Daysha Trujillo, Plumas Lake, CA (US); Tharon Trujillo, Plumas Lake, CA (US)

( * ) Notice: Subject to any disclaimer, the term of this patent is extended or adjusted under 35 U.S.C. 154(b) by 754 days.

(21) Appl. No.: 12/147,785

(22) Filed: Jun. 27, 2008

(65) Prior Publication Data

US 2008/0256865 A1 Oct. 23, 2008

Related U.S. Application Data

(63) Continuation-in-part of application No. 11/510,877, filed on Aug. 25, 2006, now abandoned.

(51) Int. Cl.
*E06B 3/32* (2006.01)

(52) U.S. Cl. ..... 49/463; 49/50; 49/56; 49/57

(58) Field of Classification Search ..... 49/50, 55, 49/56, 57, 463, 505, 63, 67
See application file for complete search history.

(56) References Cited

U.S. PATENT DOCUMENTS

| | | | | | |
|---|---|---|---|---|---|
| 4,702,036 | A * | 10/1987 | Johnson | 49/55 |
| 5,105,868 | A * | 4/1992 | Riise | 160/90 |
| 5,454,415 | A * | 10/1995 | Bolling et al. | 160/105 |
| 5,528,859 | A | 6/1996 | Taylor et al. | |
| 5,552,768 | A * | 9/1996 | Mikiel et al. | 340/546 |
| 5,632,514 | A * | 5/1997 | Johnson, Jr. | 292/95 |
| 5,860,250 | A | 1/1999 | Hill et al. | |
| 5,927,011 | A | 7/1999 | Sickenius | |
| 6,233,874 | B1 | 5/2001 | Johnson, Jr. | |
| 6,532,703 | B1 | 3/2003 | Barrens | |
| 6,557,611 | B1 * | 5/2003 | Fuentes | 160/10 |
| 7,024,820 | B1 | 4/2006 | Dustin | |
| 7,152,372 | B2 * | 12/2006 | Cheng | 49/465 |
| 7,178,792 | B2 * | 2/2007 | Monahan et al. | 256/73 |
| 2006/0288527 | A1 * | 12/2006 | Van Vliet | 16/82 |

OTHER PUBLICATIONS

Patent Cooperation Treaty, International Search Report and the Written Opinion of the International Searching Authority, International App. No. PCT/US07/18709, Apr. 28, 2008.

* cited by examiner

*Primary Examiner* — Katherine w Mitchell
*Assistant Examiner* — Catherine A Kelly
(74) *Attorney, Agent, or Firm* — Tharon Trujillo; James Trujillo

(57) ABSTRACT

A safety gate for efficiently controlling ingress or egress for children, pets, and the like into and out of a designated area. The safety gate generally includes a support adapted to be secured to a sliding door structure, a gate including a first end and a second end, wherein the gate is movably attached to the support and a latching mechanism extending from the second end of the gate to selectively secure the gate in a closed position. The gate is adapted to extend across an opening formed between a sliding door and a door frame of the sliding door structure. The first end is movably connected to the support on a first side of the opening and the second end moves about an opposing side of the opening to adjust the gate to an open position or a closed position with respect to the opening.

18 Claims, 10 Drawing Sheets

10
12
26
30
32
28
21
24
13
42
33
40
41

10
12
26
28
21
24
13
32
30
33
40
41
42

SAFETY GATE

CROSS REFERENCE TO RELATED APPLICATIONS

I hereby claim benefit under Title 35, United States Code, Section 120 of U.S. patent application Ser. No. 11/510,877 filed Aug. 25, 2006. This application is a continuation in-part of the application Ser. No. 11/510,877. The application Ser. No. 11/510,877 is now abandoned. The application Ser. No. 11/510,877 is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to safety gates and more specifically it relates to a safety gate for efficiently controlling ingress or egress for children, pets, and the like into and out of a designated area.

2. Description of the Related Art

Any discussion of the related art throughout the specification should in no way be considered as an admission that such related art is widely known or forms part of common general knowledge in the field.

A variety of currently existing safety gates are designed and constructed to restrict, prevent or otherwise control the ingress or egress of infants, children, pets and the like within or about a designated area. Such gates may be adjusted for use in passageways or openings of varying widths or related dimensions. Several such gates often include movable bumpers, which may be extended from and retracted into the safety gate structure to secure or release the safety gate from contiguous openings.

A disadvantage of convention gates employing movable bumpers is that various mechanisms used to actuate the bumpers are relatively complex and expensive. Such gates conventionally incorporate multiple mechanisms to achieve bumper actuation and include numerous interconnecting parts requiring precise fittings and positioning to interact operationally in order to extend and retract the bumpers. Other conventional gates utilize actuating mechanism that includes a complex arrangement of links, cranks, pull rods or springs that interconnect to a pull handle.

Another disadvantage of conventional gates is an inability of associated movable plungers to compensate for different spacing between each bumper and the side member of an opening. Different spacing can result from various factors, such as surface irregularities of the vertical members of an opening, an opening having nonparallel vertical members and the like. Moreover, many conventional gates use rigid connections between bumpers and corresponding actuating mechanism, which may either result in a bumper making minimal or no contact with a vertical member of the opening, or a bumper exerting an excessive force against the vertical member of an opening.

Conventional gates are also functionally limited by their inability to attach securely to a corresponding sliding door structure without slipping or otherwise becoming disengaged. Because of the inherent problems with the related art, there is a need for a new and improved safety gate for efficiently controlling ingress or egress for children, pets, and the like into and out of a designated area.

BRIEF SUMMARY OF THE INVENTION

The general purpose of the present invention is to provide a safety gate that has many of the advantages of the safety gates mentioned heretofore. The invention generally relates to a safety gate which includes a support adapted to be secured to a sliding door structure, a gate including a first end and a second end, wherein the gate is movably attached to the support and a latching mechanism extending from the second end of the gate to selectively secure the gate in a closed position. The gate is adapted to extend across an opening formed between a sliding door and a door frame of the sliding door structure. The first end is movably connected to the support on a first side of the opening and the second end moves about an opposing side of the opening to adjust the gate to an open position or a closed position with respect to the opening.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a safety gate for efficiently controlling ingress or egress for children, pets, and the like into and out of a designated area.

Another object is to provide a safety gate that is to be utilized in a sliding door structure to obstruct openings associated with the sliding doors, patio doors and other similar structures.

An additional object is to provide a safety gate that may be attached within various size openings created by differing sliding doors.

A further object is to provide a safety gate that may be positioned within the track of the sliding door.

Another object is to provide a safety gate that includes an alarm means to provide notification when the safety gate disengages or otherwise is breached.

Another object is to provide a safety gate that permits a user to leave their sliding door open and corresponding screen door closed during use, which permits air circulation throughout the home or other designated area.

Another object is to provide a safety gate that does not require any hardware to install, wherein the safety gate fits securely within the track of a sliding door.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
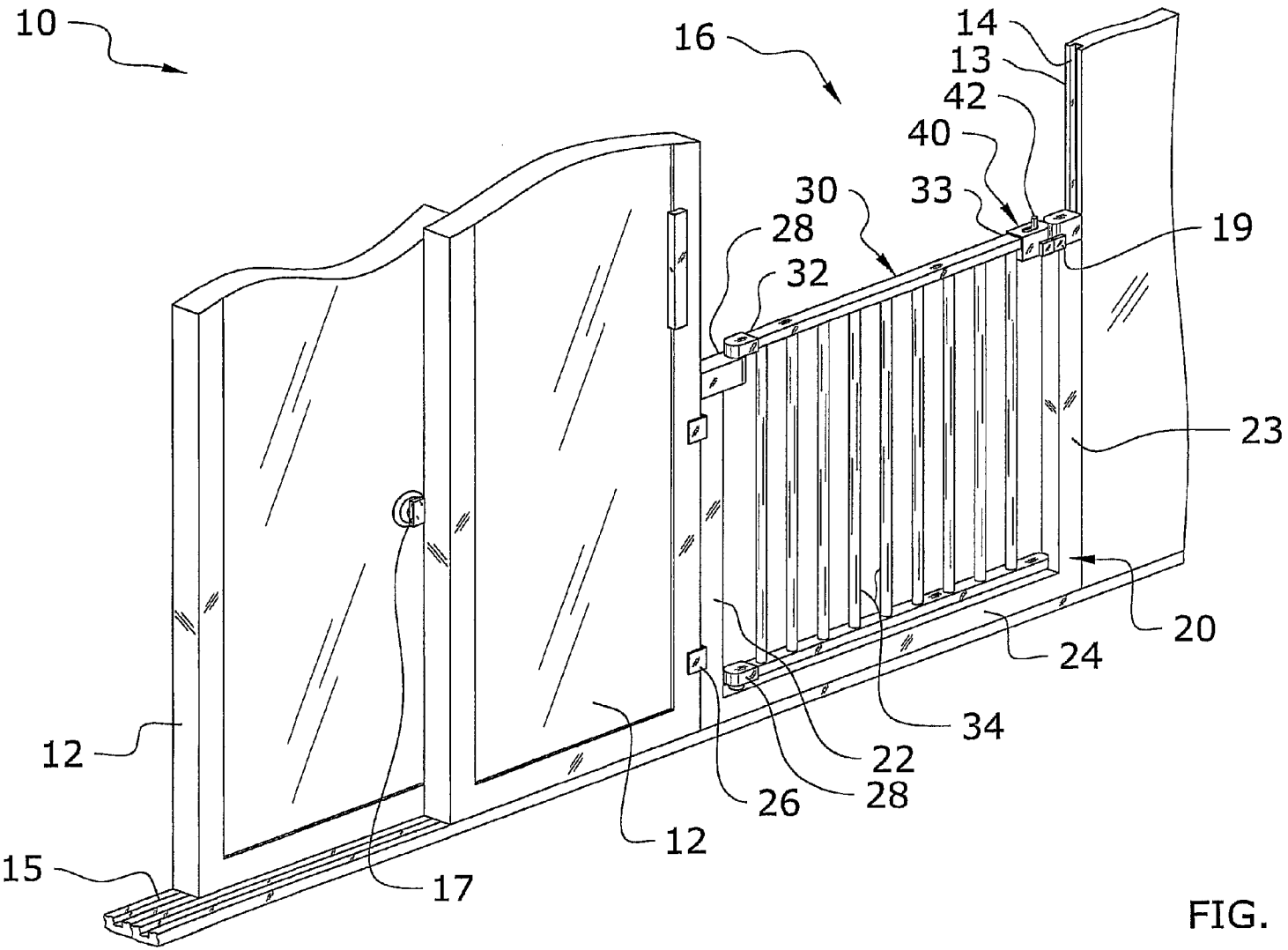
FIG. 1 is an upper perspective view of the preferred embodiment of the present invention attached within an opening defined by a sliding door structure.
Figure 2:
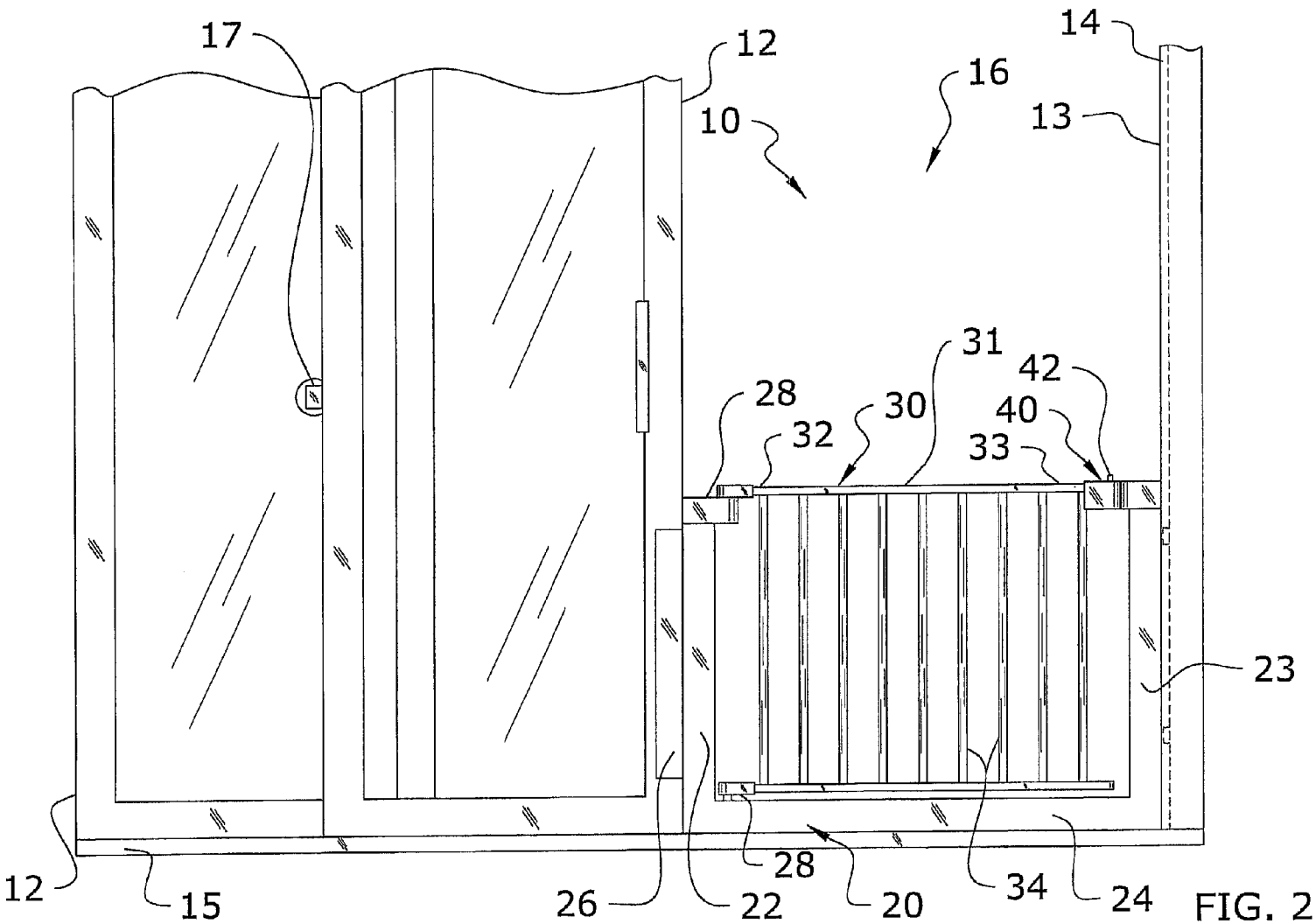
FIG. 2 is a front view of the preferred embodiment of the present invention attached within an opening defined by a sliding door structure.
Figure 3:
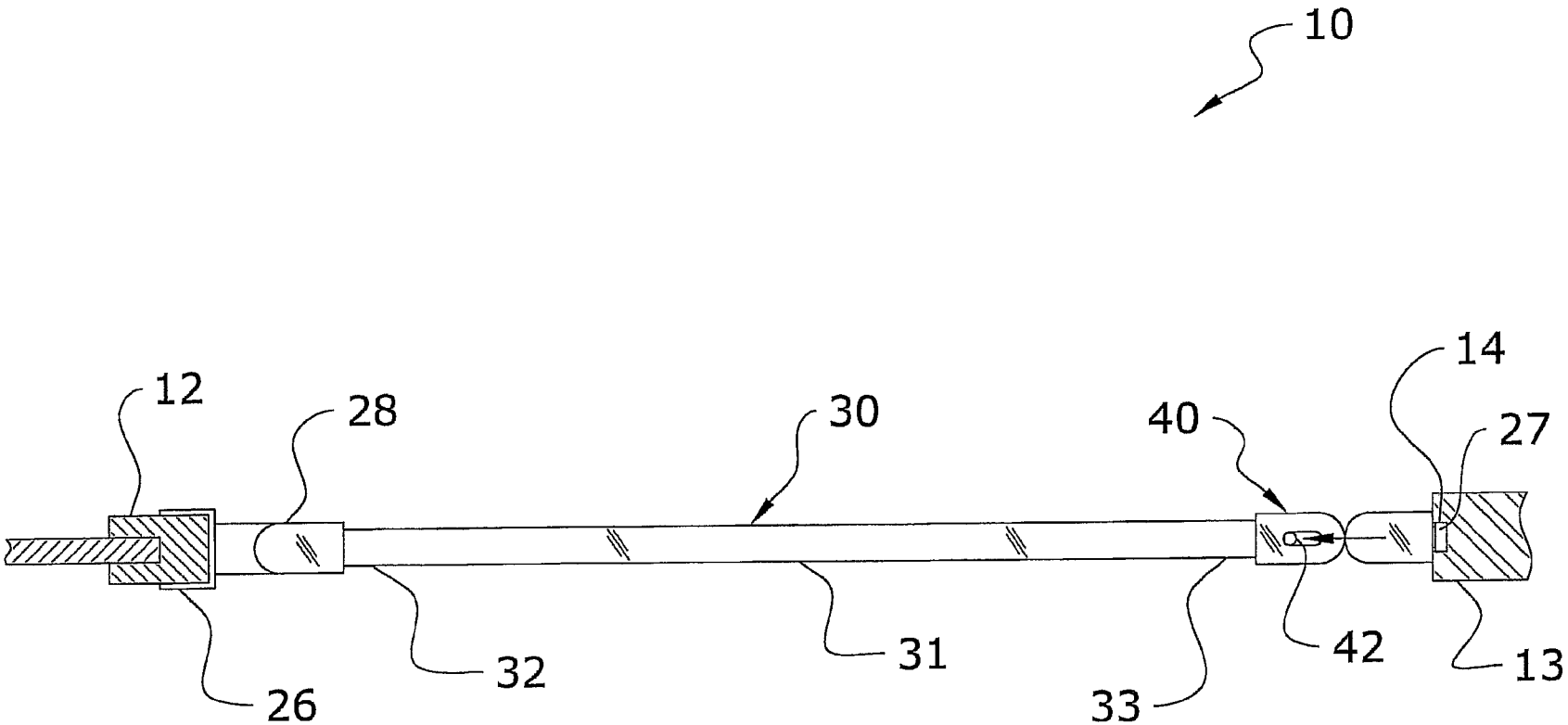
FIG. 3 is a top view of the preferred embodiment of the present invention attached within an opening defined by a sliding door structure.
Figures 4A, 4B:
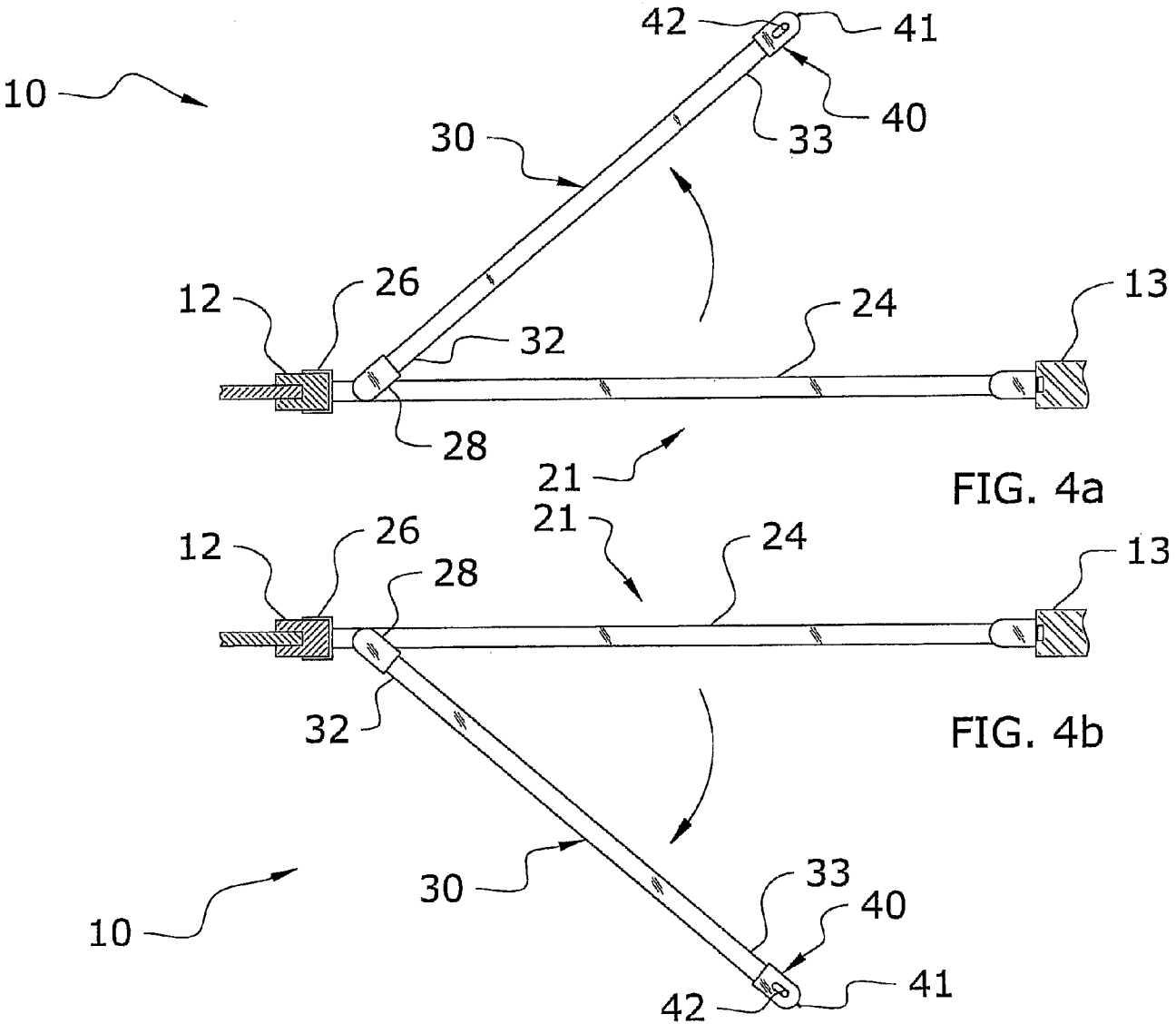
FIGS. 4*a* and 4*b* are top views illustrating the preferred embodiment of the present invention, wherein the gate is being swung open and illustrating how the gate may swing in either direction.
Figure 5:
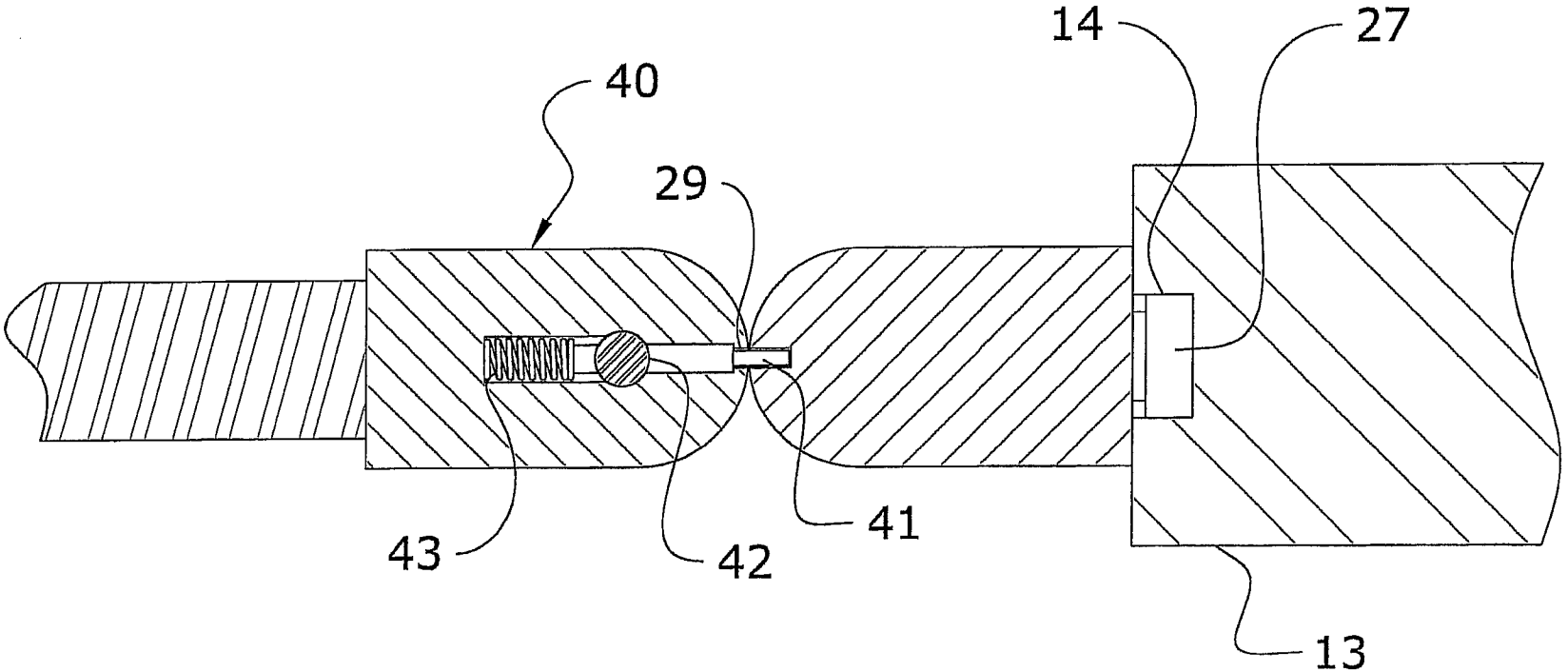
FIG. 5 is a magnified cross-sectional top view illustrating the latching mechanism of the preferred embodiment.
Figure 6:
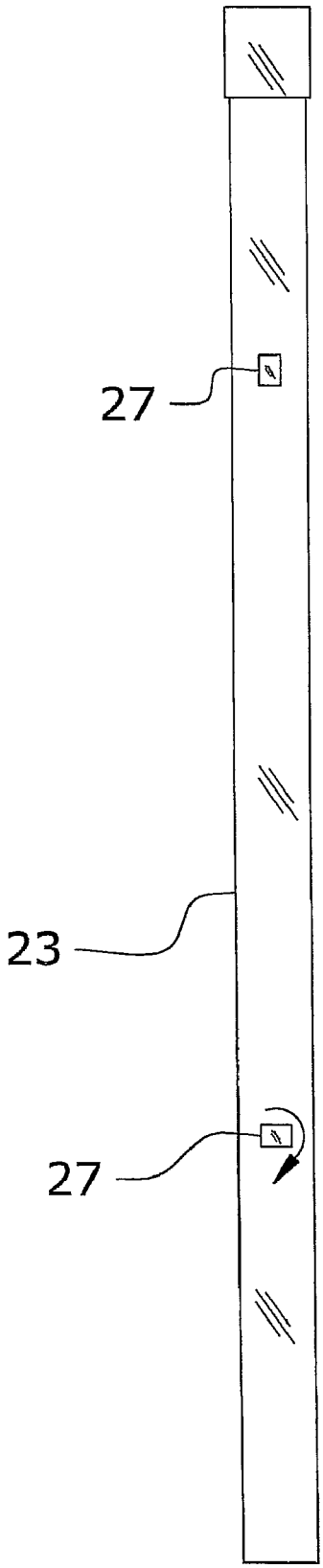
FIG. 6 is an end view of the gate of the preferred embodiment illustrating the adjustment member being able to rotatably adjust.
Figure 7:
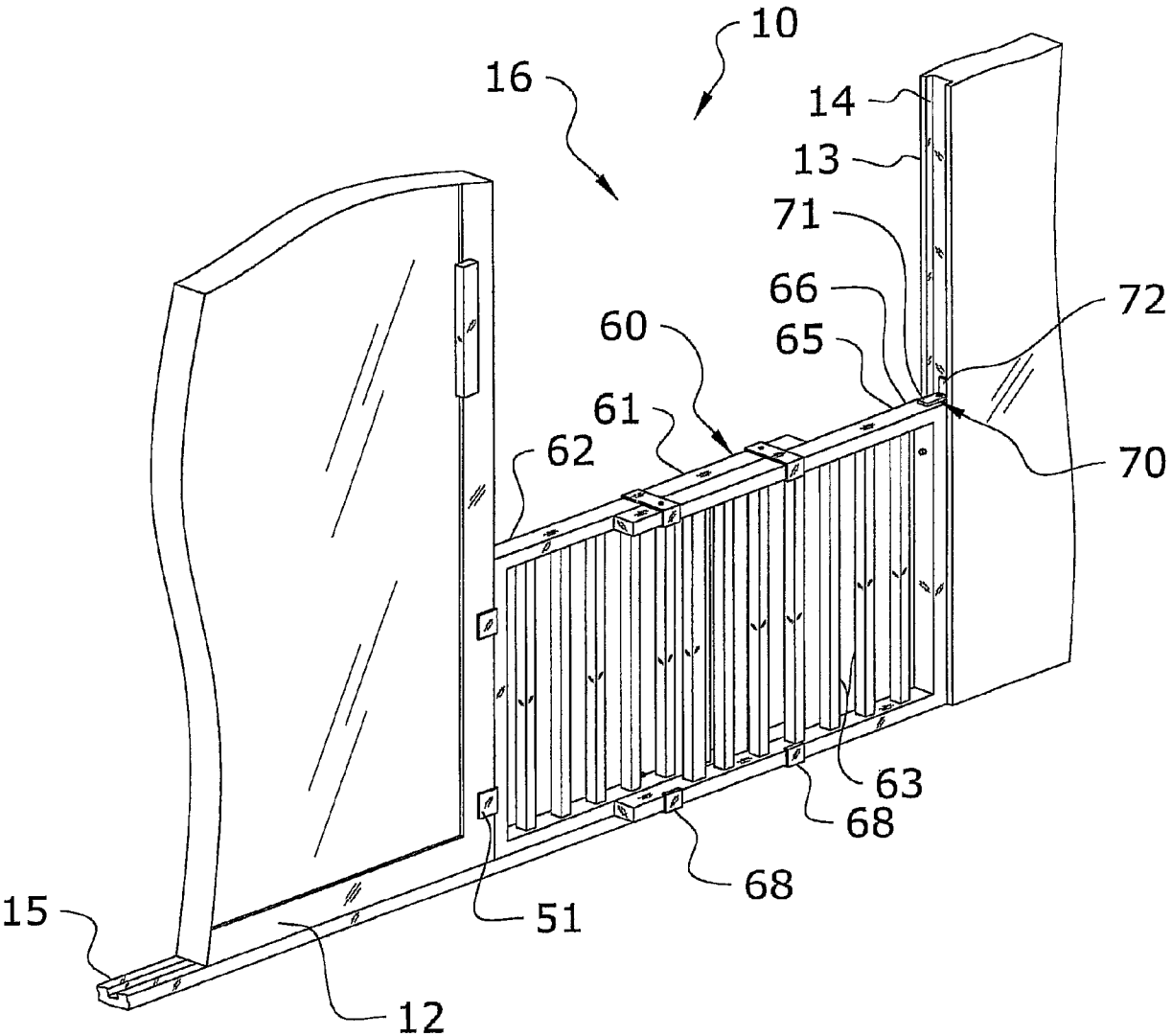
FIG. 7 is an upper perspective view of the alternate embodiment of the present invention attached within an opening defined by a sliding door structure.
Figure 8:
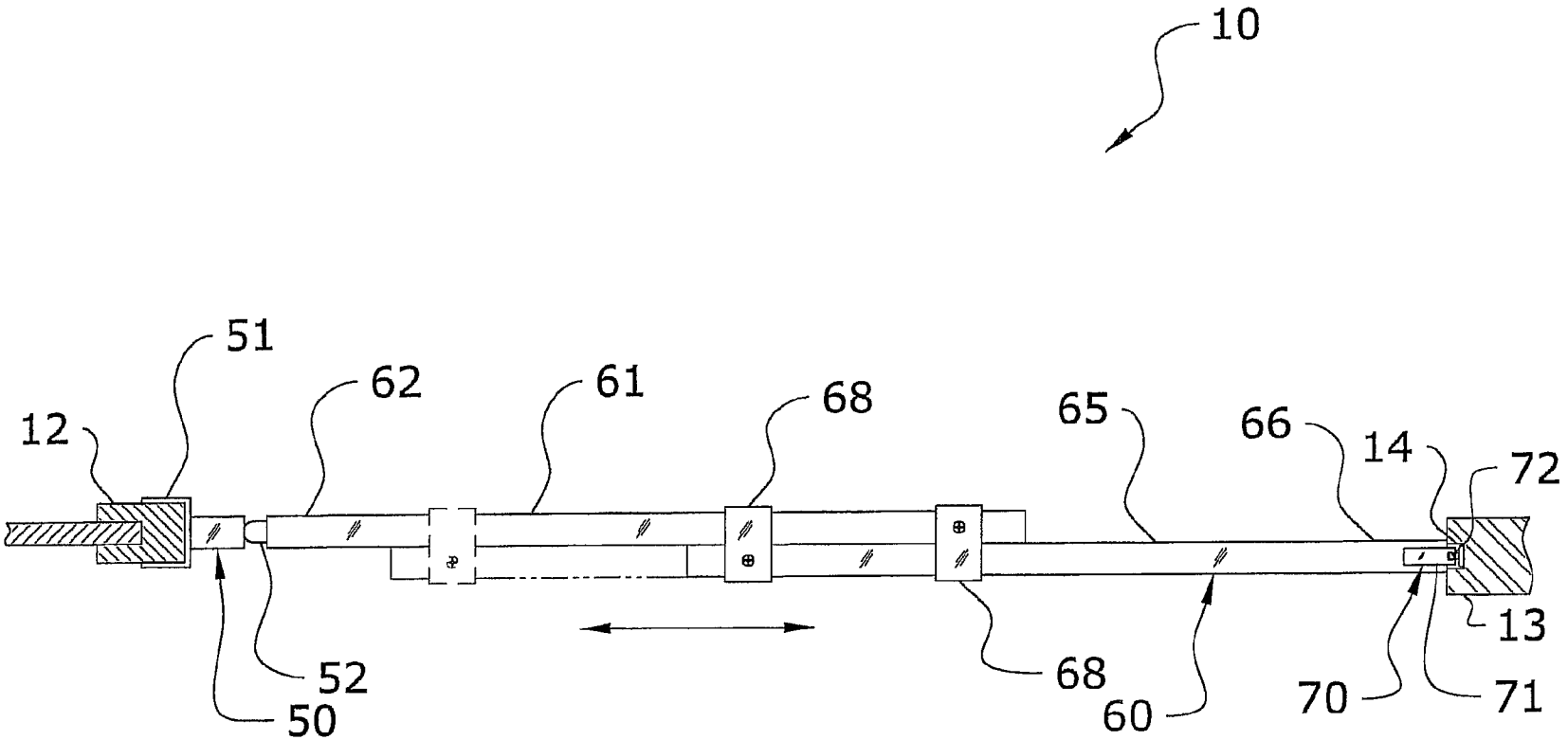
FIG. 8 is a top view of the alternate embodiment of the present invention attached within an opening defined by a sliding door structure and illustrating the panels adjusting with respect to one another.
Figure 9:
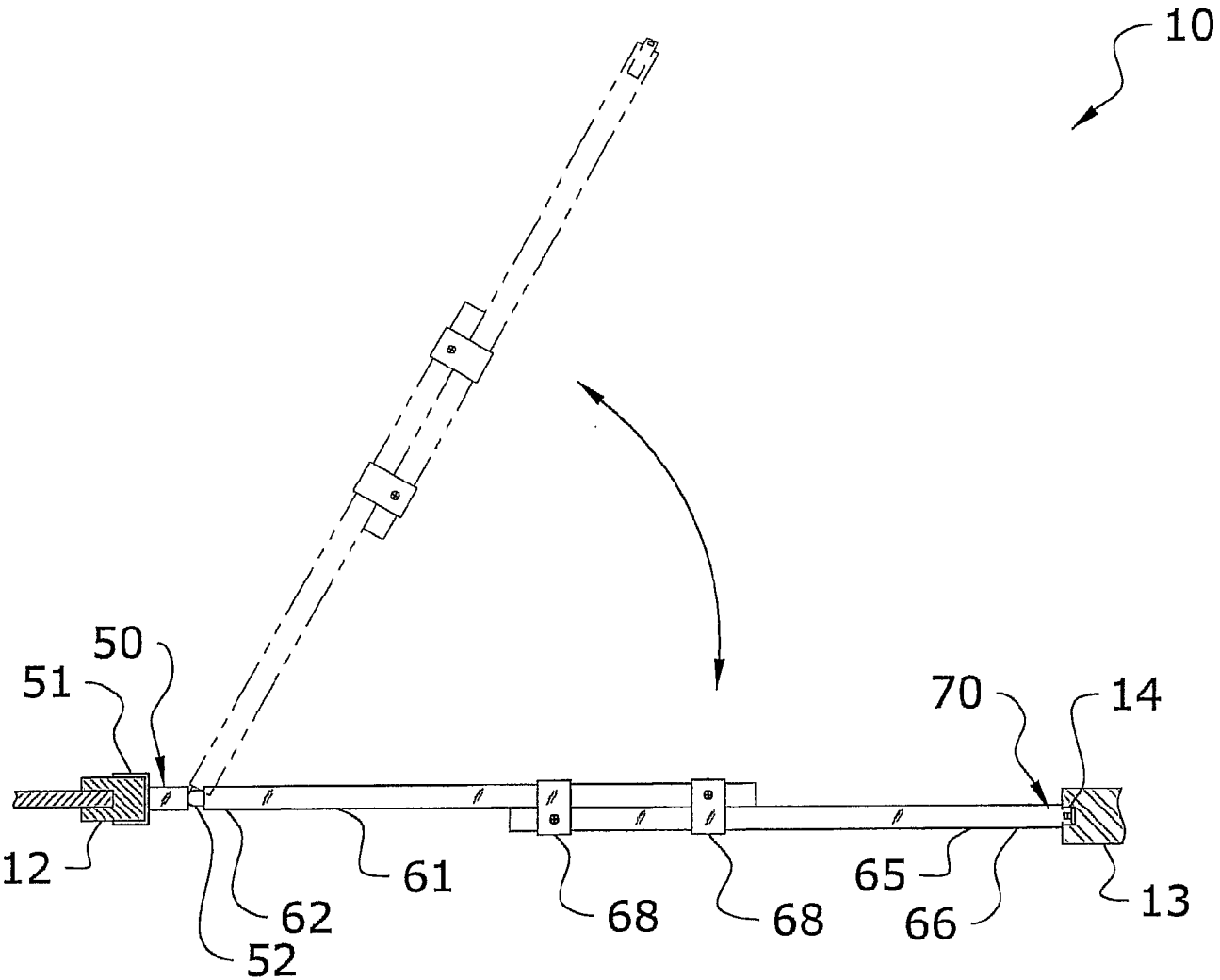
FIG. 9 is a top view illustrating the alternate embodiment of the present invention, wherein the gate is being swung open.
Figure 10:
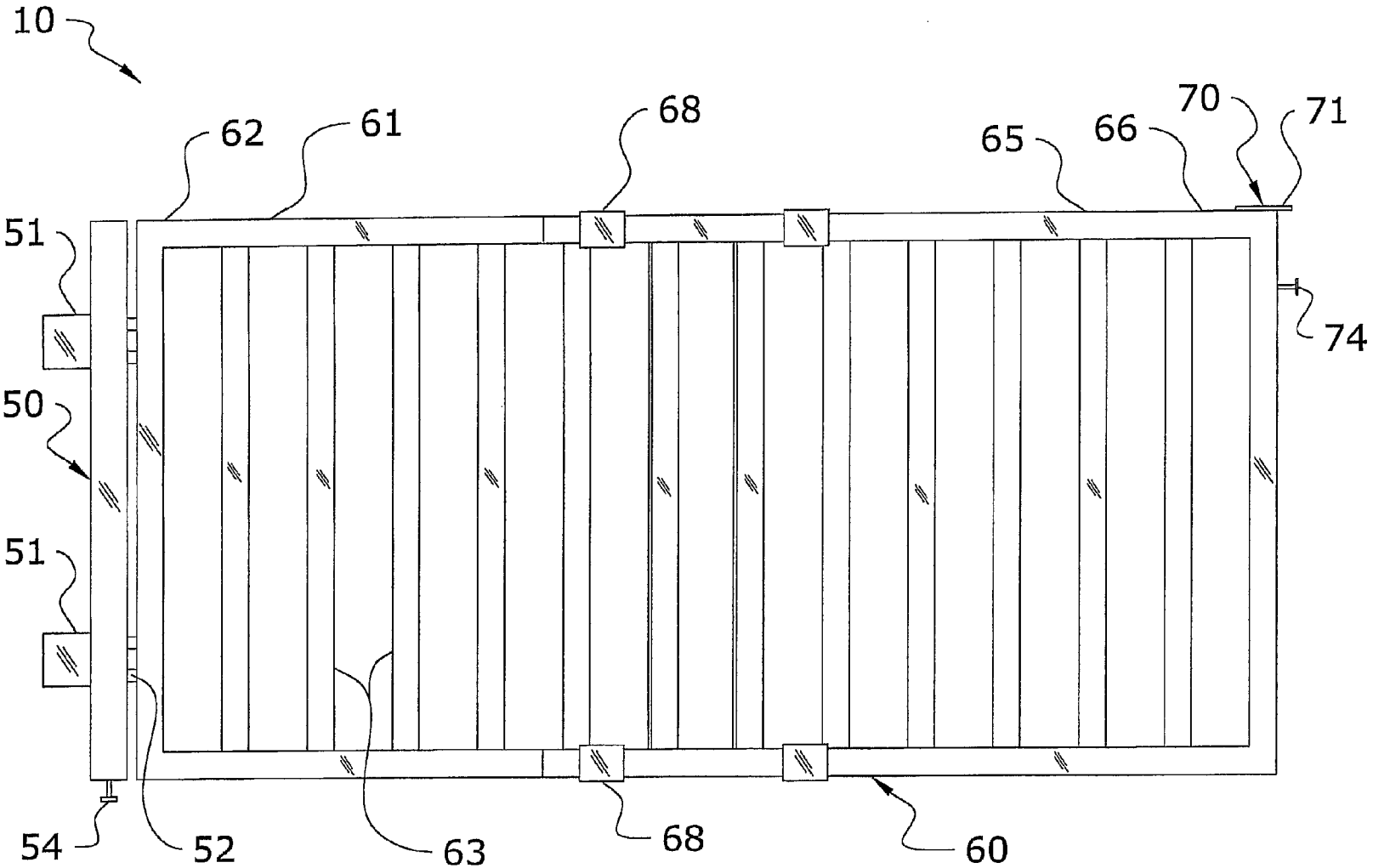
FIG. 10 is a front view of the alternate embodiment of the present invention.

Turning now descriptively to the drawings, in which similar reference characters denote similar elements throughout the several views, FIGS. 1 through 10 illustrate a safety gate 10, which comprises a support 20, 50 adapted to be secured to a sliding door structure, a gate 30, 60 including a first end (i.e. pivoting end 32, 62) and a second end (i.e. locking end 33, 66), wherein the gate 30, 60 is movably attached to the support 20, 50 and a latching mechanism 40, 70 extending from the second end 33, 66 of the gate 30, 60 to selectively secure the gate 30, 60 in a closed position. The gate 30, 60 is adapted to extend across an opening 16 formed between a sliding door 12 and a door frame 13 (i.e. door jamb, door rail) of the sliding door structure. The first end 32, 62 is movably connected to the support 20, 50 on a first side of the opening 16 and the second end 33, 66 moves about an opposing side of the opening 16 to adjust the gate 30, 60 to an open position or a closed position with respect to the opening 16.

B. Sliding Door

The sliding door structure is the sliding door 12 and all the interconnecting and supporting components, such as the door frame 13, the end channel 14, the lower track 15 and any other components necessary for proper functionality of the sliding door 12. The present invention is utilized between a sliding door 12 and the associated door frame 13 to regulate ingress and egress into and out of the designated area defined by the sliding door 12. The sliding door 12 may be comprised of various sliding structures, such as but not limited to a patio door or other similar sliding structures. The sliding door 12 preferably travels along a lower track 15 at the floor of the sliding door 12 and is closed within an end channel 14 extending within or from the door frame 13.

C. Preferred Embodiment

The present invention is designed to fit within an opening 16 created between a sliding door 12 and an associated door frame 13. The present invention moves within the opening 16 of the sliding door 12, wherein one end 32, 62 of the present invention is securely attached with respect to the sliding door 12 and the other end 33, 63 is able to move and simply is secured closed via the door frame 13. The present invention preferably pivots about the opening 16; however it is appreciated that the gate 30, 60 may open and close in various other manners, such as sliding. The sliding door 12 may be held in a desired position via a stopper 17 positioned between adjacent glass doors of the sliding door 12.

The stopper 17 may be comprised of a suction cup configuration and may or may not include a handle to prevent the sliding door 12 from sliding further away from the door frame 13 when the gate 30, 60 is installed so as to maintain a tight seal around the edges of the gate 30, 60 so that individuals and pets may not walk around the gate 30, 60. The present invention as described includes a preferred embodiment and at least one alternate embodiment, both of which will be subsequently described. The preferred embodiment is described subsequently and illustrated in FIGS. 1 through 6.

i. Support

The preferred embodiment includes a support 20 to secure the associated gate 30 within the opening 16 formed by the sliding door 12. The support 20 is preferably adapted to be securely positioned within the lower track 15 of the sliding door 12 and the end channel 14 of the door frame 13. The support 20 is further adapted to be secured in a manner so as to allow a user to open and close a separate screen door without interfering with the main sliding door 12. The support 20 is also secured to the sliding door 12 so that the support 20 is secure within the opening 16 and extends entirely across the opening 16 of the sliding door 12 so as to prevent children, pets and the like from going around the outside of the support 20 when passing into or out of the designated area defined by the sliding door 12.

The support 20 also defines a passageway 21 in which the gate 30 resides in and wherein the individuals and pets are able to pass through when the gate 30 is in an open position. The support 20 is preferably comprised of a U-shaped structure. The support 20 preferably includes a first vertical support 22 to be secured to the sliding door 12, a base support 24 to be secured about the lower track 15 of the sliding door 12 and a second vertical support 23 to be secured within the end channel 14 of the door frame 13.

The vertical supports 22, 23 may be secured to the sliding door 12 and the door frame 13 in various manners, such as through the use of door clamps 26, such as U-shaped clamps or through the use of various attachment members 27. The door clamps 26 and attachment members 27 may be adjusted in various manners (e.g. threadably) to fit various size sliding doors 12 and door frames 13 and attach and detach the support 20 to the sliding door 12. The support 20 also includes a hinge structure 28, which may include multiple hinges adjacent the first vertical support 22 to allow the gate 30 to pivot with respect to the passageway 21 between an open and a closed position.

It is also appreciated that an alarm 19 may be installed between the support 20 and the gate 30 to trigger if the gate 30 is opened. The alarm 19 may be comprised of various configurations, such as but not limited to a magnetic alarm 19 in which the alarm 19 sounds if a magnetic contact is broken between the gate 30 and the support 20. The alarm 19 may be comprised of various types of audible and/or visible types.

ii. Gate

The gate 30 swings within the passageway 21 defined by the support 20 to allow egress out of and ingress into the designated area defined by the sliding door 12. The gate 30 includes a panel 31 to pivot within the passageway 21, wherein the panel 31 includes a pivoting end 32 and a locking end 33. The pivoting end 32 of the panel 31 is connected to the hinge structure 28 of the support 20. The locking end 33 of the panel 31 is selectively secured to the support 20 when the gate 30 is in the closed position. It is appreciated that the gate 30 is supported only on one end (i.e. pivoting end 32), wherein the other end (i.e. locking end 33) is able to pivot freely when in the open position. The panel 31 may also include several supporting members extending throughout to increase the strength of the panel 31.

The panel 31 includes a restricting structure 34 extending throughout the center portion of the panel 31. The restricting structure 34 may be comprised of a solid configuration and integral with the panel 31, or may be comprised of various other configurations all which prevent a child, infant or pet from passing through the center portion of the panel 31. Such configurations of the restricting structure 34 include a plurality of spaced apart vertical or horizontal members, a mesh screen or various others. It is appreciated that the gate 30 may also include more than one panel 31 to extend across the passageway 21, such as in the alternate embodiment.

iii. Latching Mechanism

The gate 30 also includes a latching mechanism 40 adjacent the locking end 33. The latching mechanism 40 secures the gate 30 in a closed position. The latching mechanism 40 is preferably positioned at the upper end of the gate 30 so as to be substantially out of reach for any children or pets to prevent the children or pets from moving the gate 30 toward an open position. The latching mechanism 40 may be comprised of various materials, such as metals, aluminum, steel, plastic, wood, particle board, or other such durable material.

The latching mechanism 40 may be comprised of various configurations. In one configuration, the latching mechanism 40 includes a locking pin 41 that extends from the gate 30 to within a cavity 29 defined within the second vertical support 23 20 or support 20. The pin 41 is extended outwards via a spring 43 and may be manually manipulated out of the cavity 29 so that the gate 30 may be opened via an actuator mechanism 42 that pushes back upon the spring 43 and also brings the locking pin 41 out of the cavity 29.

D. Alternate Embodiment

The present invention may also be comprised of various alternate embodiments. One such alternate embodiment is described subsequently and illustrated in FIGS. 7 through 10. It is appreciated that the alternate embodiments serve the same purpose as the preferred embodiment and also are still designed to be positioned within an opening 16 formed by a sliding door 12, wherein the alternate embodiments are also still supported upon one end (i.e. pivoting end 62) and are allowed to freely swing on the other end (i.e. locking end 66) when not secured to the door frame 13. Both gates 30, 60 of both embodiments thus only need one door frame 13 on one end (i.e. pivoting end 62) of the gate 30, 60.

i. Support

The support 50 of the alternate embodiment preferably attaches to the sliding door 12 via at least one or a plurality of door clamps 51. The door clamps 51 may include various tightening structures to secure the door clamps 51 to the support 50 or sliding door 12 in various manners (e.g. threadably). The support 50 also preferably includes an adjustment mechanism 54 extending from the lower end of the support 50 to fit within the lower track 15 of the sliding door 12 and vertically adjust the support 50 and thus gate 60 to a desired height.

The adjustment mechanism 54 may vertically adjust in various manners, such as threadably adjust. The support 50 includes a hinge structure 52, which may include a plurality of hinges to pivotally attach to the gate 60 so that the gate 60 may pivot about the support 50.

ii. Gate

The gate 60 is attached within the opening 16 defined by the sliding door 12 and to the support 50. The gate 60 includes a first panel 61 connected to the support 50 upon a pivoting end 62 of the first panel 61 and a second panel 65 adjustably connected to the first panel 61 to be secured to the door frame 13 via a locking end 66 of the second panel 65. The first panel 61 and the second panel 65 preferably are able to adjust about one another via a plurality of connecting clamps 68 or other connecting structure (e.g. grooved channel) so as to adjust the length of the entire gate 60 and thus fit in multiple width openings 16 of sliding doors 12.

The connecting clamps 68 may also be replaced with a spring loaded locking mechanism which operatively attached to the first panel 61 and the second panel 65 and either engages or disengages the panels during lengthening of the gate 60. The connecting clamps 68 may be comprised of various materials, such as metals, aluminum, steel, plastic, wood, particle board, or other such durable material. The panels 61, 65 may also include several supports 50 extending throughout to increase the strength of the panels 61, 65.

Both the first panel 61 and the second panel 65 also each include a restricting structure 63, 67 extending throughout the center portion of the panel 61, 65. The restricting structures 63, 67 may be comprised of a solid configuration and integral with the panel 61, 65, or may be comprised of various other configurations all which prevent a child, infant or pet from passing through the center portion of the panel 61, 65. Such configurations of the restricting structures 63, 67 include a plurality of spaced apart vertical or horizontal members, a mesh screen or various others. It is appreciated that the gate 60 may also be comprised of one panel 61 to extend across the opening 16, such as in the preferred embodiment.

iii. Latching Mechanism

The latching mechanism 70 is adjacent the locking end 66. The latching mechanism 70 secures the gate 60 in a closed position. The latching mechanism 70 may be comprised of various materials, such as metals, aluminum, steel, plastic, wood, particle board, or other such durable material. The latching mechanism 70 includes a first connector 71 comprised of a hook configuration which may attach to a second receiver connector extending from the door frame 13.

The latching mechanism 70 may also include a spring loaded tension mechanism 74 to act as a bumper and to also prevent the gate 60 from engaging the door frame 13 when being swung from an open position to a closed position. The tension mechanism 74 also keeps pressure on the connectors, so to open the gate 60 the gate 60 is pushed forward against the tension mechanism 74 allowing the spring to compress and then the gate 60 is lifted up to release the first connector 71 from the second connector 72.

E. Operation of Preferred Embodiment

In use, the support is positioned within the opening 16 formed between the sliding door 12 and the door frame 13. The support 20 is secured within the opening 16. The stopper 17 is also ensured to be positioned at the opposing side of the sliding door 12 to prevent the sliding door 12 from sliding further from the door frame 13 then desired. The attached gate 30 may now be swung from a closed position to an open position as desired by simply releasing the latching mechanism 40 when it is desired to open the gate 30. The present invention may be removed from the sliding door 12 when not in use and stored away, wherein generally to remove the present invention from the sliding door 12, the door clamps 26 need simply to be removed.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A child safety gate for attachment to a sliding door, comprising:

a support adapted to be secured to a sliding door structure, wherein said support is secured within a track of said sliding door structure, said support comprises at least a first and a second vertical support;

a gate movably attached to said support;

wherein said gate is adapted to extend across an opening formed between a sliding door and a door frame of said sliding door structure;

wherein said gate includes a first end and a second end;

wherein said first end is movably connected to said support on a first side of said opening and wherein said second end moves about an opposing side of said opening to adjust said gate to an open position or a closed position with respect to said opening; wherein said second vertical support includes interchangeable attachment members including a first attachment member which is rectangular and sized to fit within a vertical groove of a vertical jamb of the door frame and a second attachment member which is a U-shaped clamp that fits over the jamb; and a latching mechanism extending from said second end of said gate to selectively secure said gate in said closed position.

2. The safety gate of claim 1, wherein said first vertical support is secured to said sliding door of said sliding door structure.

3. The safety gate of claim 2, wherein said first vertical support includes at least one door clamp to connect to said sliding door.

4. The safety gate of claim 1, wherein said support is positioned within a lower track of said sliding door structure.

5. The safety gate of claim 1, wherein said support is comprised of a U-shaped configuration.

6. The safety gate of claim 1, wherein said support vertically adjusts via an adjustment mechanism.

7. The safety gate of claim 1, wherein said gate is pivotally attached to said support.

8. The safety gate of claim 1, wherein said gate includes a first panel and a second panel, wherein said first panel and said second panel are operatively connected to adjust a length of said gate.

9. The safety gate of claim 1, including an alarm connected to said door to provide notification when said gate is moved to said open position.

10. The safety gate of claim 1, wherein said latching mechanism includes a spring and actuator mechanism.

11. The safety gate of claim 1, including a stopper to secure said sliding door of said sliding door structure in place.

12. The safety gate of claim 11, wherein said stopper is comprised of a suction cup configuration.

13. The safety gate of claim 1, wherein said sliding door structure is comprised of a sliding patio door structure.

14. A child safety gate for attachment to a sliding door, comprising:

a support adapted to be secured to a sliding door of a sliding patio door structure, wherein said support is secured within a track of said sliding door structure, said support comprises at least a first and a second vertical support;

a gate pivotally attached to said support;

wherein said gate is adapted to extend across an opening formed between a sliding door and a door frame of said sliding patio door structure;

wherein said gate includes a first end and a second end;

wherein said first end is pivotally connected to said support on a first side of said opening and wherein said second end pivots about an opposing side of said opening to adjust said gate to an open position or a closed position with respect to said opening; wherein said second vertical support includes interchangeable attachment members including a first attachment members which is rectangular and sized to fit within a vertical groove of a vertical jamb of the door frame and a second attachment member which is a U-shaped clamp that fits over the jamb; and a latching mechanism extending from said second end of said gate to selectively secure said gate in said closed position.

15. The safety gate of claim 14, wherein said support is comprised of a U-shaped configuration.

16. The safety gate of claim 14, wherein said gate includes a first panel and a second panel, wherein said first panel and said second panel are operatively connected to adjust a length of said gate.

17. The safety gate of claim 14, including a stopper to secure said sliding door of said sliding door structure in place.

18. A child safety gate for attachment to a sliding door, comprising:

a support adapted to be secured to a sliding door of a sliding door structure, wherein said support is secured within a track of said sliding door structure, said support comprises at least a first and a second vertical support;

a gate pivotally attached to said support;

wherein said gate is adapted to extend across an opening formed between a sliding door and a door frame of said sliding door structure;

wherein said gate includes a first end and a second end;

wherein said first end is pivotally connected to said support on a first side of said opening and wherein said second end pivots about an opposing side of said opening to adjust said gate to an open position or a closed position with respect to said opening; wherein said second vertical support includes interchangeable attachment members including a first attachment members which is rectangular and sized to fit within a vertical groove of a vertical jamb of the door frame and a second attachment member which is a U-shaped clamp that fits over the jamb;

a latching mechanism extending from said second end of said gate to selectively secure said gate in said closed position;

wherein said first vertical support includes at least one door clamp to connect to said sliding door;

wherein said support is comprised of a U-shaped configuration;

an alarm connected to said door to provide notification when said gate is moved to said open position;

wherein said latching mechanism includes a spring and actuator mechanism; and a stopper to secure said sliding door of said sliding door structure in place, wherein said stopper is comprised of a suction cup configuration;

wherein said sliding door structure is comprised of a sliding patio door structure.

* * * * *